US008545634B2

(12) United States Patent
Lafon et al.

(10) Patent No.: US 8,545,634 B2
(45) Date of Patent: Oct. 1, 2013

(54) SYSTEM AND METHOD FOR CLEANING A CONDITIONING DEVICE

(75) Inventors: Jean-Marc Lafon, Meylan (FR); Silvio Delmonaco, Avezzano (IT); Sebastien Petitdidier, Gieres (FR)

(73) Assignees: Freescale Semiconductor, Inc., Austin, TX (US); STMicroelectronics SRL, Agrate Brianza (IT); STMicroelectronics (Crolles 2) SAS, Crolles (FR)

( * ) Notice: Subject to any disclaimer, the term of this patent is extended or adjusted under 35 U.S.C. 154(b) by 431 days.

(21) Appl. No.: 12/090,186

(22) PCT Filed: Oct. 19, 2005

(86) PCT No.: PCT/EP2005/012343

§ 371 (c)(1),
(2), (4) Date: Apr. 14, 2008

(87) PCT Pub. No.: WO2007/045267

PCT Pub. Date: Apr. 26, 2007

(65) Prior Publication Data

US 2008/0311834 A1 Dec. 18, 2008

(51) Int. Cl.
*B08B 3/12* (2006.01)

(52) U.S. Cl.
USPC ..... 134/1; 134/1.3; 451/444

(58) Field of Classification Search
USPC ..... 134/1, 1.3; 451/444
See application file for complete search history.

(56) References Cited

U.S. PATENT DOCUMENTS

| | | | | |
|---|---|---|---|---|
| 5,801,066 | A * | 9/1998 | Meikle | 438/14 |
| 5,863,838 | A | 1/1999 | Farkas et al. | |
| 5,885,134 | A | 3/1999 | Shibata et al. | |
| 5,957,750 | A | 9/1999 | Brunelli | |
| 6,224,461 | B1 | 5/2001 | Boehm, Jr. et al. | |
| 6,290,808 | B1 | 9/2001 | McKee et al. | |
| 6,341,997 | B1 | 1/2002 | Lin | |
| 6,443,814 | B1 | 9/2002 | Miller et al. | |
| 6,444,569 | B2 | 9/2002 | Farkas et al. | |
| 6,464,568 | B2 | 10/2002 | Miller et al. | |

(Continued)

FOREIGN PATENT DOCUMENTS

| | | | |
|---|---|---|---|
| EP | 0566258 | B1 | 6/1996 |
| EP | 1055486 | A2 | 11/2000 |

(Continued)

OTHER PUBLICATIONS

Azar, Lawrence. "Understanding and Evaluating Ultrasonic and Magasonic Cleaners," Products Finishing Oct. 2007, printed from "www.pfonline.com/articles/pc/09-100708-pc.html" on Mar. 23, 2010, 3 pages.

(Continued)

*Primary Examiner* — Michael Kornakov
*Assistant Examiner* — Katelyn Whatley

(57) ABSTRACT

A system for cleaning a conditioning device to improve the efficiency of the conditioning of a polishing pad using the conditioning device as part of a chemical-mechanical polishing process, the system comprising a conditioning device; a fluid dispenser arranged to dispense a fluid on the conditioning device; and an acoustic nozzle arranged to emit a megasonic or ultrasonic signal at the conditioning device while the fluid dispenser is dispensing the fluid on the conditioning device.

14 Claims, 2 Drawing Sheets

(56) References Cited

U.S. PATENT DOCUMENTS

| | | | | |
|---|---|---|---|---|
| 6,488,573 | B1 | 12/2002 | Kobayashi et al. | |
| 6,517,424 | B2 | 2/2003 | Wielonski et al. | |
| 6,554,951 | B1 * | 4/2003 | Page et al. | 156/345.12 |
| 6,592,433 | B2 | 7/2003 | Buehler | |
| 6,593,282 | B1 | 7/2003 | Li et al. | |
| 6,609,962 | B1 * | 8/2003 | Wakabayashi et al. | 451/443 |
| 6,632,127 | B1 | 10/2003 | Zimmer et al. | |
| 6,666,754 | B1 * | 12/2003 | Beckage | 451/56 |
| 6,780,088 | B1 | 8/2004 | Nishihara | |
| 6,884,146 | B2 * | 4/2005 | Lehman et al. | 451/5 |
| 6,896,586 | B2 | 5/2005 | Pham et al. | |
| 6,951,503 | B1 * | 10/2005 | Gotkis et al. | 451/9 |
| 6,953,750 | B1 | 10/2005 | Wu et al. | |
| 7,150,675 | B2 | 12/2006 | Kramer et al. | |
| 7,169,014 | B2 | 1/2007 | Taylor et al. | |
| 7,452,264 | B2 | 11/2008 | Mavliev et al. | |
| 2002/0039877 | A1 | 4/2002 | Svirchevski et al. | |
| 2002/0102922 | A1 | 8/2002 | Miller et al. | |
| 2002/0106976 | A1 | 8/2002 | Miller et al. | |
| 2002/0107155 | A1 | 8/2002 | Miller et al. | |
| 2003/0060127 | A1 * | 3/2003 | Kaushal et al. | 451/8 |
| 2003/0073391 | A1 | 4/2003 | Janzen | |
| 2003/0119692 | A1 | 6/2003 | So et al. | |
| 2003/0194949 | A1 | 10/2003 | Buehler | |
| 2003/0207778 | A1 | 11/2003 | So et al. | |
| 2003/0216049 | A1 | 11/2003 | Sun et al. | |
| 2004/0154931 | A1 | 8/2004 | Hongo et al. | |
| 2007/0077871 | A1 | 4/2007 | Park et al. | |
| 2008/0182490 | A1 | 7/2008 | Fang et al. | |
| 2008/0287041 | A1 | 11/2008 | Kordic et al. | |

FOREIGN PATENT DOCUMENTS

| | | | |
|---|---|---|---|
| EP | 1175964 | A2 | 1/2002 |
| JP | 2001328069 | A | 11/2001 |
| TW | 586463 | | 5/2004 |

OTHER PUBLICATIONS

U.S. Appl. No. 12/093,113, Non-Final Office Action, Mar. 25, 2010, 11 pages.

* cited by examiner

SYSTEM AND METHOD FOR CLEANING A CONDITIONING DEVICE

FIELD OF THE INVENTION

The present invention relates to system and method for cleaning a conditioning device to improve the efficiency of the conditioning of a polishing pad using the conditioning device as part of a chemical-mechanical polishing process.

BACKGROUND OF THE INVENTION

Modern integrated circuit IC devices typically employ shallow trench isolation and multi-level interconnects to meet the demands for increased functionality and faster processing speeds. However, planarization of interlevel dielectrics, conductive layers and trench dielectrics are required when using these technologies to obtain optimum fabrication results.

One technique that provides planarization and has received widespread acceptance in the semiconductor processing industry is chemical-mechanical polishing CMP.

CMP is used to planarize and remove surface topography irregularities of a material layer through chemical reaction and mechanical abrasion.

Typically a CMP process involves placing a semiconductive substrate (e.g. a semiconductive wafer) face down on a polishing pad where the polishing pad is attached to a rotatable table, or platen. An abrasive fluid, known as slurry, is introduced onto the surface of the polishing pad while the polishing pad is being rotated and the substrate is pressed against the polishing surface of the polishing pad. Additionally, the substrate may also be rotated in conjunction with the rotating polishing pad.

The polishing of the substrate by the chemical mechanical process is provided by chemical interaction of the slurry, which includes a chemical reagent, with the substrate and abrasives contained within the slurry, where typical abrasives used in the CMP include silica, alumina and ceria. However, other abrasives may be used.

The polishing process starts with the chemical interaction between the slurry and the substrate (i.e. material layer) with the abrasives in the slurry, coupled with the rotational movement of the polishing pad, physically stripping the reacted surface material from the substrate. The polishing process continues until the desired amount of the material layer is removed. Upon completion of the polishing process the substrate is subjected to a cleaning process to remove residual slurry and foreign particles.

However, by semiconductor fabrication standards CMP is inherently a dirty process, which in addition to a significant amount of foreign particles being introduced to the substrate surface also results in a significant amount of foreign particles, for example abrasive particles and by products of the planerization, being introduced to the polishing pad that can result in an undesirable built up of particles on the polishing pad, which is an effect known as 'pad glazing'.

Pad glazing results in the smoothing of the upper surface (i.e. working surface) of the polishing pad causing a reduction in the abrasive properties of the polishing pad and consequently a reduction in the polishing rate. Additionally, the 'glaze' is often unevenly distributed over a polishing pad surface, which can result in localized differences in polishing rate and increased polishing non-uniformity.

One way to alleviate this problem has been via the use of a conditioning device that is used to remove the 'glaze' and other unwanted particles from the polishing pad.

The technique of conditioning the polishing pad with a conditioning device involves mechanically abrading the polishing pad surface to remove the glaze and 'renew' the polishing pad surface.

The conditioning surface of a conditioning device typically includes an abrasive surface, for example diamonds, to provide the mechanical abrasion. During pad conditioning the conditioning device, for example a diamond disk, is positioned over the polishing pad and a downward force applied such that the conditioning surface of the conditioning device is in abrasive contact with the polishing surface. The conditioning device may sweep back and forth across the surface of the polishing pad, which may be rotated, to facilitate removal of the glaze across the surface of the polishing pad. A rinsing fluid, for example deionised water, is typically injected onto the polishing pad to aid in the removal of abraded glaze from the polishing pad surface. However, it has been found that the use of a chemical reagent in place of the deionised water helps reduce the accumulated glaze on the polishing pad.

However, it has been found that abrasive particles and by products generated as a result of the polishing process can be transferred from the polishing pad onto the conditioning device resulting in a build up of a film, comprising unwanted particles, on the conditioning device.

As a result of a film build-up on the conditioning device the conditioning capabilities of the conditioning disk are reduced resulting in a lower removal rate of unwanted particles from the polishing pad by the conditioning device and less uniform conditioning of the polishing pad by the conditioning device.

This problem is further exacerbated in that there are no convenient means of monitoring the condition of the conditioning device and consequently the current solution to this problem is to change the conditioning disk on a regular basis rather than when the conditioning device is determined to be no longer suitable for conditioning of a polishing pad.

It is desirable to improve this situation.

SUMMARY OF THE INVENTION

In accordance with an aspect of the present invention there is provided a system and method for cleaning a conditioning device to improve the efficiency of the conditioning of a polishing pad as part of a chemical-mechanical polishing process according to the accompanying claims.

This provides the advantage of improving the efficiency and cleanliness of a conditioning device and for extending the life of a conditioning device, thereby extending the time before a conditioning device requires to be changed. The invention also has the additional advantage of allowing an accurate assessment of the condition of a conditioning device, thereby avoiding the need to replace the conditioning device unnecessarily.

BRIEF DESCRIPTION OF THE DRAWINGS

An embodiment of the invention will now be described, by way of example, with reference to the drawings, of which.

DETAILED DESCRIPTION OF THE PREFERRED EMBODIMENTS

Figure 1:
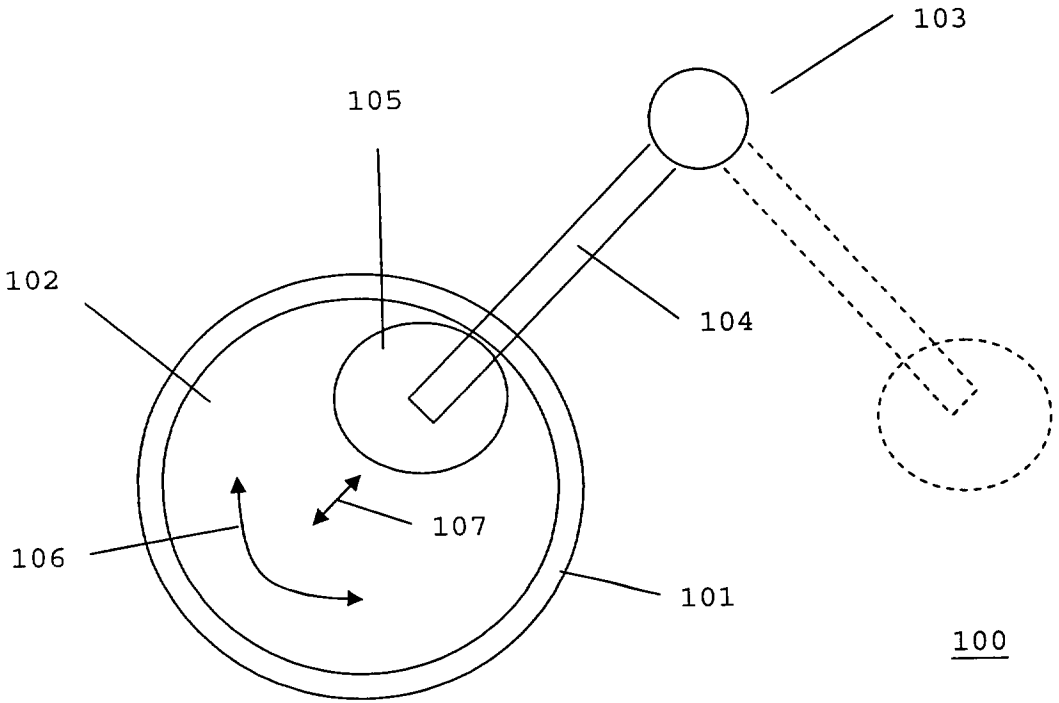
FIG. 1 illustrates a top plan of a pad conditioning system.

FIG. 1 illustrates a top plan of a pad conditioning system 100 that may be used in a chemical-mechanical polishing process.

The pad conditioning system 100 includes a platen 101. The platen 101 is arranged to rotate clockwise or counter-clockwise about a fixed or movable axis. A polishing pad 102 is attached to the platen 101 and as such is rotated by the platen 101. The polishing pad 102 is arranged to provide mechanical abrasion for removing a material layer from a substrate (not shown) during a chemical-mechanical polishing process, as is well known to a person skilled in the art.

The pad conditioning system 100 further includes a conditioning device 103 having a conditioning arm 104 that is pivoted to allow the conditioning arm 104 to be disposed either away from the polishing pad 102, as shown by dotted lines, or above the polishing pad 102. Attached to the conditioning arm 104, at the opposite end to the pivot, is a conditioning disk 105, for example a diamond disk. The conditioning disk 105 includes a conditioning surface that during conditioning of the polishing pad 102 is in abrasive contact with the polishing pad 102, where the conditioning surface includes an abrasive surface in order to facilitate removal of glaze that may be present on the polishing pad 102. The abrasive surface will typically include periodic protrusions, for example diamonds, that extend partially into the surface of the polishing pad 102 during the conditioning of the polishing pad 102 by the conditioning device 103. The conditioning surface of the conditioning disk 105 may also have a metal coating formed over it to assist in the retention of diamonds on the conditioning surface. The metal coating is ideally chosen to be compatible with any chemical reagents that may be used on the conditioning surface.

To aid the conditioning process the conditioning disk 105 may be rotated in the same or opposite direction to that of the polishing pad 102. The conditioning disk 105 may be swept back and forth along polishing pad, shown by arrows 106. Additionally, the conditioning disk may be moved from an inner portion of the polishing pad to an outer portion of the polishing pad, as shown by arrow 107.

While the conditioning device 103 is not being used to condition the polishing pad 102 the conditioning device 103 may be placed in a storage position away from the polishing pad 102, as shown by the dotted lines in FIG. 1.

Figure 2:
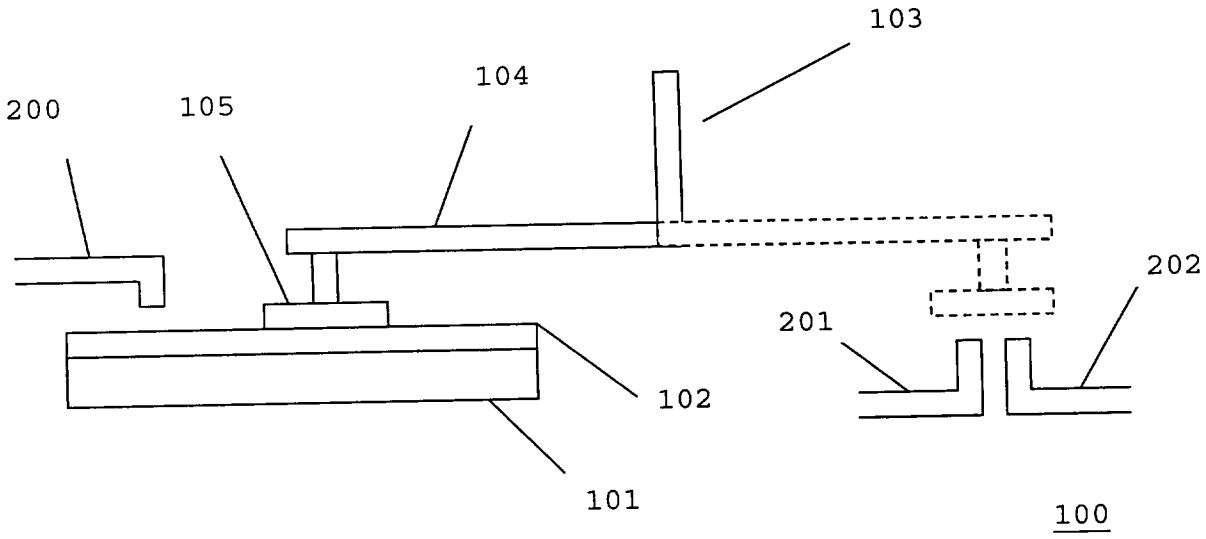
FIG. 2 illustrates a side view of a pad conditioning system according to an embodiment of the present invention.

FIG. 2 illustrates a side view diagram of the pad conditioning system 100 where the same features as those shown in FIG. 1 have the same reference numerals. Located above the polishing pad 102 is a first conduit 200 arranged to dispense a rinsing fluid and/or a chemical reagent, for example Ammonium hydroxide, onto the polishing pad 102. The chemical reagent will typically be chosen to have minimum aggressive action on the metal coating formed on the conditioning surface and should have the ability to dilute by-product agglomeration, for example dionised water, NH4OH or KOH would be suitable for oxide slurry.

However, as would be appreciated by the person skilled in the art, alternative designs for locating the first conduit 200 could be adopted, for example a conduit could be integrated into the conditioning device 103.

Although the current embodiment describes the use of a conduit for dispensing a rinsing fluid and/or chemical reagent, it is equally possible to dispense rinsing fluid and/or chemical reagent on the conditioning surface by immersing the conditioning surface in a vessel containing recirculated rinsing fluid and/or chemical reagent.

As also shown in FIG. 2, and as stated above, the conditioning device 103 may be suspended in a storage position away from the polishing pad 102, as shown by the dotted lines.

In the storage position, located under the surface of the stored conditioning disk 102, is a second conduit 201 and an acoustic nozzle 202. The second conduit 201 is arranged to dispense a rinsing fluid and/or a chemical reagent onto the conditioning surface of the conditioning disk 105. The second conduit is preferably located below the surface of the conditioning disk 105 such that the chemical reagent and/or rinsing fluid is injected upwards towards the conditioning surface.

The force of the chemical reagent and/or rinsing fluid being dispensed on the conditioning surface is preferably suitable for removing glaze or slurry build up that may be present on the conditioning surface.

The acoustic nozzle 202 is arranged to emit a megasonic and/or ultrasonic wave at the conditioning surface for agitating the surface of the conditioning disk 105 to aid in the removal of glaze and slurry build up on the conditioning surface, which is further assisted by the use of the chemical reagent and/or rinsing fluid being dispensed on the conditioning surface.

As would be appreciated by a person skilled in the art the acoustic nozzle 202 could be mounted in a variety of different locations and could even be positioned above the conditioning surface with the emitted megasonic/ultrasonic waves being directed at the conditioning surface through the conditioning disk 105. Further, the acoustic nozzle 202 is not restricted to being located in the region of the storage position and could, for example, be positioned in other locations.

The cleaning of the conditioning disk 105 via the use of chemical reagent and/or rinsing fluid in conjunction with the agitation of the conditioning disk 105 from the use of megasonic/ultrasonic waves will typically be performed for a predetermined period of time.

By performing the above process the conditioning disk 105 can be kept in optimum condition. However, it is inevitable that the condition of the conditioning surface of the conditioning disk 105 will deteriorate with use.

To assist in the identification of the condition of the conditioning surface of the conditioning disk 105 various monitoring techniques may be adopted. The various monitoring techniques may be used to assist in determining when a conditioning disk 105 should be replaced. The monitoring of the conditioning surface may be performed before and/or after cleaning of the conditioning surface and as such the monitoring of the conditioning disk does not have to be limited to only after the conditioning disk has been conditioned.

A first monitoring technique for monitoring the conditioning surface of the conditioning disk 105 relies upon optical analysis of the conditioning surface.

The optical analysis may, for example, be performed by optically comparing the conditioning surface before and after a polishing pad 102 has been conditioned by the conditioning device 103, where the optical comparison could be performed on a pixel by pixel comparison to identify differences in the condition of the conditioning surface.

Alternatively, the optical analysis could be performed by measuring the intensity of light reflected from the surface of the conditioning surface, where, for example, a laser source (not shown) could be used as the light source. As such as the reflected light levels increase this can be used as an indication of the deteriorating condition of the conditioning surface. As such, a threshold level could be set for the reflected light, such that upon a detection of reflected light levels above the threshold the conditioning pad can either be conditioned or replaced. Preferably light intensity values would be taken from all of the conditioning surface.

A second monitoring technique for monitoring the conditioning surface of the conditioning disk relies upon making a resistance measurement of the metal coating applied to the conditioning surface. A metal coating applied to the conditioning surface can start to corrode as a result of being in contact with the slurry used between the substrate (not shown) and the polishing pad 102 and as a result can lead to surface leakage and yield, which can contribute to metallic contamination of a wafer surface. The resistance measurement of the metal coating is used as an indication of the amount of material that has been lost from the conditioning surface, where, for example, the resistance value could be linked to the metal thickness.

A third monitoring technique for monitoring the conditioning surface relies upon eddy currents induced by an external RF generator (not shown). The external RF generator is configured to generate an electromagnetic signal that is arranged to cause eddy currents to flow in the conditioning disk 105, where the detected intensity of the eddy currents flowing in the conditioning disk 105 are used as an indication of the condition of the conditioning surface.

It will be apparent to those skilled in the art that the disclosed subject matter may be modified in numerous ways and may assume embodiments other than the preferred forms specifically set out as described above, for example the pad conditioning system may include more than one polishing pad and associated conditioning device.

The invention claimed is:

1. A system for cleaning a conditioning device that is used to condition a polishing pad as part of a chemical-mechanical polishing process, the system comprising:

the conditioning device;

a fluid dispenser having a conduit arranged to inject a fluid onto a conditioning surface of the conditioning device and an acoustic nozzle arranged to emit a megasonic or ultrasonic signal onto the conditioning surface of the conditioning device while the fluid dispenser is injecting the fluid onto the conditioning surface; and means for monitoring a condition of the conditioning surface of the conditioning device, wherein the means for monitoring includes an optical system having a laser emitter for emitting a laser beam at the conditioning surface of the conditioning device and a light sensor for determining an intensity of reflected laser light from the conditioning surface, wherein the conditioning surface of the conditioning device includes a diamond disk having an arrangement of diamonds coated on a surface of the diamond disk.

2. A system according to claim 1, wherein the fluid dispenser is arranged to dispense deionised water.

3. A system according to claim 1, wherein the fluid dispenser is arranged to dispense a chemical reagent.

4. A systems according to claim 3, wherein the dispensed chemical reagent is $NH_4OH$ or KOH.

5. A system according to claim 1, wherein the means for monitoring comprises means for monitoring deterioration of the conditioning device.

6. A method for cleaning a conditioning device that is used to condition a polishing pad as part of a chemical-mechanical polishing process, the method comprising:

injecting a fluid onto a conditioning surface of the conditioning device;

emitting a megasonic or ultrasonic signal onto the conditioning surface of the conditioning device while the fluid is being injected onto the conditioning surface; and monitoring a condition of the conditioning surface of the conditioning device, wherein monitoring the condition comprises emitting a laser beam at a conditioning surface of the conditioning device and determining an intensity of reflected laser light from the conditioning surface, wherein the conditioning surface of the conditioning device includes a diamond disk having an arrangement of diamonds coated on a surface of the diamond disk.

7. The method of claim 6, wherein the fluid includes deionised water.

8. The method of claim 6, wherein the fluid includes a chemical reagent.

9. The method of claim 8, wherein the chemical reagent is $NH_4OH$ or KOH.

10. The method of claim 6, wherein monitoring the condition comprises monitoring deterioration of the conditioning device.

11. A system according to claim 1, wherein the means for monitoring is to compare the intensity of light to a threshold.

12. The method of claim 6, further comprising comparing the intensity of reflected laser light with a threshold.

13. The method of claim 12, further comprising replacing the conditioning pad when the intensity is above the threshold.

14. A system for cleaning a conditioning device that is used to condition a polishing pad as part of a chemical-mechanical polishing process, the system comprising:

the conditioning device;

a fluid dispenser having a conduit arranged to inject a fluid onto a conditioning surface of the conditioning device and an acoustic nozzle arranged to emit a megasonic or ultrasonic signal onto the conditioning surface of the conditioning device while the fluid dispenser is injecting the fluid onto the conditioning surface; and a monitoring technique comprising:

an optical system to monitor a condition of the conditioning surface of the conditioning device, the optical system having a laser emitter for emitting a laser beam at the conditioning surface of the conditioning device and a light sensor for determining an intensity of reflected laser light from the conditioning surface, wherein the conditioning surface of the conditioning device includes a diamond disk having an arrangement of diamonds coated on a surface of the diamond disk.

* * * * *